US005215106A

United States Patent [19]

Choi

[11] Patent Number: 5,215,106

[45] Date of Patent: Jun. 1, 1993

[54] HAIR-PAINTING COMB DEVICE WITH A CONTAINER CONTAINING A HAIRSTYLING SOLUTION

[76] Inventor: Jae Y. Choi, Han Yang APT. 233-dong 207, Sunbu dong 1086, Ansan-si, Kyunggi-do, Rep. of Korea

[21] Appl. No.: 973,046

[22] Filed: Nov. 6, 1992

[30] Foreign Application Priority Data

Nov. 15, 1991 [KR] Rep. of Korea ..... 91-19586

[51] Int. Cl.[5] ..... A45D 24/16

[52] U.S. Cl. ..... 132/109; 132/114; 132/116; 401/278; 401/287; 401/291

[58] Field of Search ..... 132/109, 110, 111, 114, 132/115, 116, 120; 401/278, 287, 291, 288, 272, 275, 282, 273

[56] References Cited

U.S. PATENT DOCUMENTS

| | | | |
|---|---|---|---|
| 4,940,351 | 7/1990 | Konose | 401/273 X |
| 4,966,175 | 10/1990 | Kimura et al. | 132/116 X |
| 4,993,437 | 2/1991 | Kimura et al. | 132/116 X |
| 5,035,525 | 7/1991 | Konose | 401/273 X |
| 5,054,504 | 10/1991 | Winrow | 132/110 X |

*Primary Examiner*—Gene Mancene

*Assistant Examiner*—Thomas Price

*Attorney, Agent, or Firm*—Abelman Frayne & Schwab

[57] ABSTRACT

A hair-painting comb device with a solution container containing a hairstyling solution such as a hair dye or a hair setting solution. The comb device comprises a plurality of comb members each having a sponge member, a plurality of tube members communicating with the comb members, and a plurality of valves each comprising a valve housing having an upper housing portion disposed in the interior of solution container and always communicating with the interior of the solution container to be always filled with the solution and a lower housing portion extending downwardly from the upper housing portion beyond the lower portion of the solution container and having a vertical hole receiving each corresponding tube member, a valve member seated on the upper end of vertical hole, and a compression spring interposed between the upper end of valve housing and the valve member, the compression spring serving to always urge the valve member against the upper end of the vertical hole and thus to prevent the grooves and thus the tube member from communicating with the interior of the valve housing filled with the solution.

4 Claims, 1 Drawing Sheet

HAIR-PAINTING COMB DEVICE WITH A CONTAINER CONTAINING A HAIRSTYLING SOLUTION

BACKGROUND OF THE INVENTION

1. Field of the Invention

The present invention relates to a hairstyling tool, and more particularly to a hair-painting comb device with a container containing a hairstyling solution such as a hair dye or a hair setting solution.

2. Description of the Prior Art

In hair dyeing, sprayers containing a dye solution have been conventionally used. Otherwise, a painting method have been used wherein a dye solution is contained in a container and then painted on hairs by using a separate device. On the other hand, in hair setting, sprayers containing a mousse or a hair setting agent have been used.

Although having a convenience, conventional dye sprayers disperse the dye solution and thereby contaminate peripheral areas. On the other hand, the painting method also contaminate peripheral areas and are troublesome. In case of hair setting sprayers, there are similar disadvantages.

It is the most significant problem that such conventional devices and methods are difficult to accomplish hair dyeing or hair setting at a desired area and at a desired degree.

For solving these problems, there have been proposed various devices.

For example, U.S. Pat. No. 4,323,085 discloses a hair dyeing device comprising a hollow comb element with hollow tines connected to the interior. In this hair dyeing device, a hair dyeing medium is fed by a cylinder generating a pressure. However, this device is only useful for the dye having a high viscosity.

Japanese Patent No. 95,503 discloses a cylindrical housing comprising a brush and tines serving as guide panel. This device uses an ink type binder and pigment contained in a chemical supply container. The brush is so small that it can not cover whole boundary of head. As a result, it is not commercially practical.

SUMMARY OF THE INVENTION

Therefore, it is an object of the invention is to eliminate the above-mentioned problems encountered in the prior arts and to provide a hair-painting comb device with a container containing a hairstyling solution, capable of achieving easy hair dyeing and setting at a desired hair area and at a desired degree.

In accordance with the present invention, this object can be accomplished by a hair-painting comb device comprising: a main housing having a partition member for dividing the interior of said main housing into an upper chamber and a lower chamber, said partition member having a plurality of throughout holes; a plurality of hollow comb members disposed within said lower chamber of the main housing, to extend downwardly from the bottom surface of the partition member and to communicate with said throughout holes of the partition member, respectively, each of said comb members having a sponge member fitted around the comb member and adapted to be soaked with a solution supplied to the interior of the comb member; a solution passage member fitted in said upper chamber of the main housing and having at its lower portion a plurality of solution passages each communicating with each throughout hole of the partition member; a plurality of hollow tube portions extending upwardly from said lower portion of said solution passage member and communicating with at least one of said solution passages, each of said tube portions having at its upper end with at least one groove; a solution container fitted in the solution passage member, to slide upwardly and downwardly; valve means disposed at the lower portion of said solution container and adapted to communicate the solution passages with the interior of the solution container via said grooves only when the solution container slides downwardly; a cover separably coupled to the upper end of the main housing and having a central opening; and a push button member disposed at the upper portion of the solution container to be protruded through said central opening of said cover.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1:
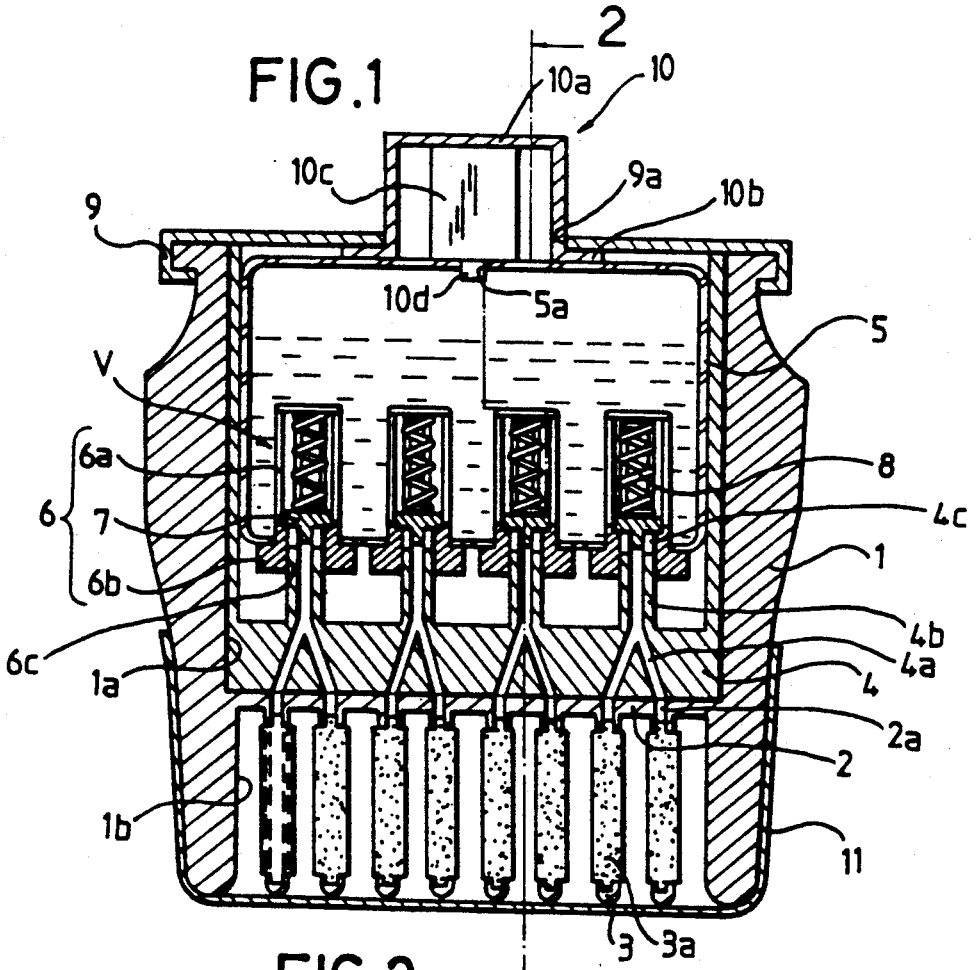
FIG. 1 is a sectional view of a hair-painting comb device according to the present invention.
Figure 2:
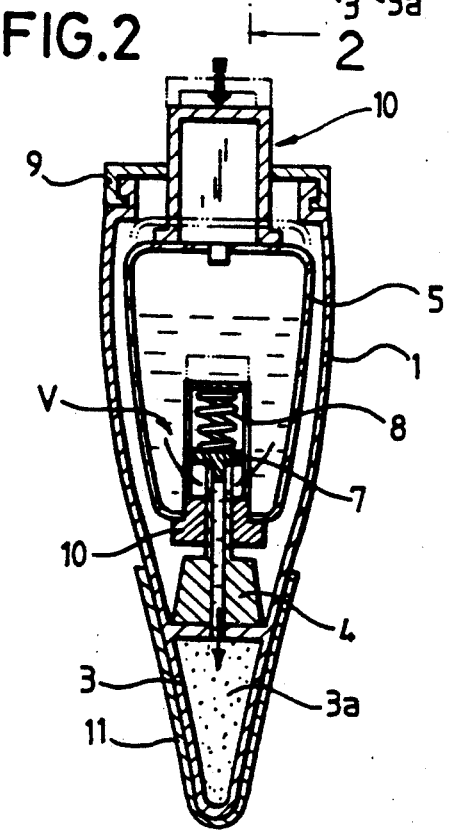
FIG. 2 is a cross-sectional view taken along the line A—A of FIG. 1.

Referring to FIGS. 1 and 2, there is illustrated a hair-painting comb device in accordance with the present invention.

As shown in the drawings, the comb device comprises a main housing 1 having a partition member 2 for dividing the interior of main housing 1 into an upper chamber 1*a* and a lower chamber 1*b*. The partition member 2 has a plurality of throughout holes 2*a*. In the illustrated embodiment, the partition member 2 is formed integrally with the main housing 1.

Within the lower chamber 1*b* of main housing 1, a plurality of hollow comb members 3 are disposed to extend downwardly from the bottom surface of partition member 2 and to communicate with the throughout holes 2*a* of partition member 2, respectively. Around each comb member 3, a sponge member 3*a* is fitted so that it can be soaked with a solution supplied to the interior of the comb member 3.

In the upper chamber 1*a* of main housing 1, a solution passage member 4 is fitted which has at its lower portion a plurality of solution passages 4*a* each communicating with each throughout hole 2*a* of the partition member 2. The solution passage member 4 also has a plurality of hollow tube portions 4*b* extending upwardly from the lower portion. In the illustrated embodiment, each hollow tube portion 4*b* communicates with two solution passages. Each tube portion 4*b* is provided at its upper end with a pair of grooves 4*c*.

In the solution passage member 4, a solution container 5 is fitted to slide upwardly and downwardly. The solution container 5 has at its lower portion a plurality of valves V each comprising a valve housing 6 having an upper housing portion 6*a* disposed in the interior of solution container 5 and a lower housing portion 6*b* extending downwardly from the upper housing portion 6*a* beyond the lower portion of solution container. The upper housing portion 6*a* of each valve housing 6 always communicates with the interior of solution container 5 so that it is always filled with the solution. On the other hand, the lower housing portion 6a of each valve housing 6 has a vertical hole 6c for receiving each corresponding tube portion 4b of the solution passage member 4. With this construction, each tube portion 4b of the solution passage member 4 serves to guide the vertical slide movement of the solution container 5. The vertical hole 6c of each valve V is communicated with the interior of each corresponding tube portion 4b of the solution passage member 4, via the grooves 4c formed at the tube portion 4b. Each valve V also comprises a valve member 7 seated on the upper end of its vertical hole 6c and a compression spring 8 interposed between the upper end of valve housing 6 and the valve member 7. The compression spring 8 serves to always urge the valve member 7 against the upper end of vertical hole 6c and thus to prevent the vertical hole 6c and the tube portion 4b of solution passage member 4 from communicating with the interior of valve housing 6 filled with the solution.

To the upper end of main housing 1, a cover 9 having a central opening 9a is separably fitted in a snap manner. On the other hand, a push button member 10 is disposed at the upper portion of the solution container 5 so that it is protruded through the central opening 9a of cover 9. The push button member 10 has an inverted U-shape including a pair of space side portions 10a each having a lateral extension 10b. The push button member 10 is provided at its center portion with a column portion 10c which extends downwardly and has at its lower end a protrusion 10d fitted in an aperture 5a formed at the upper portion of solution container 5. The side portions 10a of push button member 10 are spaced apart from opposite side edges of the column portion 10b, respectively, so that they have a flexibility in a lateral direction. By virtue of such a flexibility, the lateral distance between the lateral extensions 10b of push button member 10 can be reduced when the side portions 10a are pressed toward each other, so that the push button member 10 can access to the opening 9a of cover 9, for its assembling and separation.

A cap 11 is separably put on the lower portion of main housing 1. The cap 11 serves to prevent the solution socked in the sponge members 3a of comb members 3 from being dried.

The solution contained in the solution container 5 may be a dye or a mousse as a hair setting agent. The dye is not correct terminology but is a paint consisting of a binder and a pigment. Here, the used paint is soluble in alcohol so it is not harmful, comparing with the dye. The pigment adheres to hair by the binder of hair paint using combing.

Now, the operation of the hair-painting comb device according to the present invention will be described.

As the push button member 10 is downwardly pressed, the solution container 5 is downwardly moved in the solution passage member 4 against the forces of compression springs 8 of the valves V, as shown in FIG. 2. At this time, the downward movement of solution container 5 is guided by the tube portions 4b of solution passage member 4 inserted in the corresponding vertical holes 6c of the valves V. By the downward movement of solution container 5, the upper portion of each tube portion 4b of solution passage member 4 which has been disposed in the vertical hole 6c of the corresponding valve V is separated from the same vertical hole 6c and then disposed in the interior of upper valve housing portion 6a of the same valve V filled with the solution. As a result, the solution in the interior of each upper valve housing portion 6a enter the corresponding tube portion 4b of the solution passage member 4 through the grooves 4c formed at the upper end of the same tube portion 4b. The solution entering each tube portion 4b flows into the corresponding two solution passages 4a and then the throughout holes 2a of partition member 2 communicating with the solution passages 4a. Accordingly, the solution can enter the comb members 3 so that sponge members 3a fitted around the comb members 3 can be soaked with the solution. At this state, the solution can be painted on hairs by combing.

Although the preferred embodiments of the invention have been disclosed for illustrative purpose, those skilled in the art will appreciate that various modifications, additions and substitutions are possible, without departing from the scope and spirit of the invention as disclosed in the accompanying claims.

What is claimed is:

1. A hair-painting comb device comprising:

a main housing having a partition member for dividing the interior of said main housing into an upper chamber and a lower chamber, said partition member having a plurality of throughout holes;

a plurality of hollow comb members disposed within said lower chamber of the main housing, to extend downwardly from the bottom surface of the partition member and to communicate with said throughout holes of the partition member, respectively, each of said comb members having a sponge member fitted around the comb member and adapted to be soaked with a solution supplied to the interior of the comb member;

a solution passage member fitted in said upper chamber of the main housing and having at its lower portion a plurality of solution passages each communicating with each throughout hole of the partition member;

a plurality of hollow tube portions extending upwardly from said lower portion of said solution passage member and communicating with at least one of said solution passages, each of said tube portions having at its upper end with at least one groove;

a solution container fitted in the solution passage member, to slide upwardly and downwardly;

valve means disposed at the lower portion of said solution container and adapted to communicate the solution passages with the interior of the solution container via said grooves only when the solution container slides downwardly;

a cover separably coupled to the upper end of the main housing and having a central opening; and a push button member disposed at the upper portion of the solution container to be protruded through said central opening of said cover.

2. A hair-painting comb device in accordance with claim 1, wherein said valve means comprises a plurality of valves each comprising:

a valve housing having an upper housing portion disposed in the interior of said solution container and always communicating with the interior of the solution container to be always filled with the solution and a lower housing portion extending downwardly from said upper housing portion beyond the lower portion of the solution container and having a vertical hole receiving each corresponding tube member;

a valve member seated on the upper end of said vertical hole; and a compression spring interposed between the upper end of said valve housing and said valve member, said compression spring serving to always urge the valve member against the upper end of the vertical hole and thus to prevent the grooves and thus the tube member from communicating with the interior of the valve housing filled with the solution.

3. A hair-painting comb device in accordance with claim 1, wherein the push button member has an inverted U-shape including a pair of space side portions each having a lateral extension and is also provided at its center portion with a column portion extending downwardly and being at its lower end in contact with the upper portion of the solution container, said side portions being spaced apart from opposite side edges of the column portion, respectively, so that they have a flexibility in a lateral direction.

4. A hair-painting comb device in accordance with claim 1, further comprising a cap separably put on the lower portion of the main housing.

* * * * *